United States Patent [19]

Haskins

[11] 3,979,849

[45] Sept. 14, 1976

[54] BOLT ACTION FOR REPEATING RIFLE

[76] Inventor: Jerry D. Haskins, P.O. Box 1401, Rifle, Colo. 81650

[22] Filed: June 3, 1974

[21] Appl. No.: 475,616

[52] U.S. Cl. ..... 42/16; 42/1 C; 42/76 R

[51] Int. Cl.[2] ..... F41C 11/00; F41C 21/00; F41C 27/12

[58] Field of Search ..... 42/16, 1 C, 76 R

[56] References Cited

UNITED STATES PATENTS

| | | | |
|---|---|---|---|
| 923,244 | 6/1909 | Chadwick | 42/1 C |
| 1,044,780 | 11/1912 | Hammond | 42/16 |
| 2,803,079 | 8/1957 | Heilman | 42/16 |
| 3,013,355 | 12/1961 | Weatherby | 42/16 |
| 3,494,216 | 2/1970 | Haskins | 42/16 |
| 3,846,928 | 11/1974 | Ruger et al. | 42/16 |

*Primary Examiner*—Charles T. Jordan
*Attorney, Agent, or Firm*—William R. Laney

[57] ABSTRACT

A bolt action for a repeating rifle including an elongated hollow bolt having formed thereon, circumferentially spaced, axially extending rails which cover a major portion of the length of the bolt. One of the rails extends to the forward end of the bolt which, in the assembled rifle, is positioned inside the forward receiver ring adjacent the rear end of the barrel when the action is closed. The elongated rail cooperates with undercuts formed in the spaced lateral rails of the receiver to enable shells to be more smoothly and easily fed from the magazine to the chamber. The bolt is retained in its firing position by a plurality of locking lugs carried in the rear receiver ring which cooperate with the bolt rails. The bolt handle and bolt handle shroud are integrally formed and are a separate piece from the bolt proper which is screwed into the bolt handle shroud and pinned in this position. The bolt action further includes an automatically operated cocking indicator stud which is spring biased to an exposed position to indicate when the action of the rifle is cocked. The action further includes an improved bolt release stud which is readily accessible to the shooter and is simply constructed and reliable in operation to facilitate the quick removal or reinsertion of the bolt into the receiver of the rifle.

12 Claims, 17 Drawing Figures

BOLT ACTION FOR REPEATING RIFLE

BACKGROUND OF THE INVENTION

1. Field of the Invention

This invention relates to firearms, and more particularly, to bolt action repeating rifles.

2. Brief Description of the Prior Art

A great many types of bolt actions have been provided in repeating rifles in the last 100 years. The bolt action repeating rifle perhaps first began to achieve real prominence and popularity in the firearms field with the bolt actions developed by Paul Mauser in the 1860's. Since that time, a number of improvements and variations have been made in bolt actions to improve their reliability, the safety characteristic of rifles in which they are employed and the smoothness with which they may be operated in a rifle which can be accurately fired repetively for a number of times. It is important in bolt action rifles that the bolt, which normally operates with a reciprocating and a rotative movement, slides smoothly within the receiver of the rifle to seat freely and easily without binding or canting. It is also important that the construction of the action afford a high degree of safety to the shooter by having sufficient metal and geometric reinforcement of cooperating parts to prevent the firing recoil from driving the bolt back into the shooter's face as a result of failure of the back-up locking mechanisms. Many types of rifle bolts have, in the past, been provided with elongated lugs, rails or ribs which cooperate with locking lugs carried on the receiver at one or more places to lock the bolt in its firing status when the action is closed. In many of these constructions, however, the geometric array of the ribs or rails carried on the bolt is such that the bolt is not mechanically balanced and the forces developed during recoil, as well as the forces acting on the bolt as it is reciprocated from an open breech to a closed position tend to distort the bolt, or cause it to bind up in the receiver.

Another problem not infrequently encountered in bolt action rifles as they have been previously constructed is the tendency of the cartridge being fed from the magazine box to the chamber to bind or rub against the rails of the receiver, thus causing scoring or abrading of the case of the cartridge, and also reducing the smoothness with which the action is operated. Further, the same mechanical designs which cause the scoring of the brass shell cases (a feature which is particularly undesirable where it is desired to reload the cases) also sometimes results in a jam which, of course, interfers with the shooting of the rifle, and causes aggravating delays while the jam is cleared.

In some types of bolt action rifles, such as that described in my U.S. Pat. No. 3,494,216, the bolt release lug or lock which is provided for the purpose of allowing the bolt to be slipped out of the receiver for maintenance or repair or inspection of the receiver, or for various other purposes, is not as conveniently and readily accessible as would be optimum, and requires removal or manipulation of the trigger mechanism in order to actuate the bolt stop pin or release lug in a way to permit the bolt assembly to be completely removed from the receiver.

Finally, many of the types of bolt actions which have previously been provided in repeating rifles machine the bolt handle and bolt handle shroud integrally with the bolt, or at least the shroud itself is machined integrally with the bolt, with the result that on those occasions when it may be desirable to repair or alter the surfaces on the bolt handle shroud or to disconnect, for any reason, the bolt handle and bolt handle shroud from the bolt proper, this is a very difficult operation and generally requires replacement of the entire bolt, bolt handle shroud and bolt handle.

BRIEF DESCRIPTION OF THE PRESENT INVENTION

The bolt action of the present invention provides several improved features and advantages with respect to the types of actions previously in use. Broadly described, the bolt action of this invention comprises an elongated hollow bolt having three circumferentially spaced ribs or rails thereon which extend axially on the bolt over a major portion of its length. One of the ribs terminates flush with the forward face of the bolt. The rear end of the bolt is screwed into a bolt handle shroud and is pinned against rotation in the shroud. The bolt is reciprocably mounted in a receiver having forward and rear rings interconnected by spaced, longitudinally extending receiver rails. In the rear receiver ring, a plurality of circumferentially spaced, radially inwardly extending locking lugs are provided for locking engagement with the ribs carried on the bolt when the bolt is rotated to close the action of the rifle for firing. The forward ring of the receiver is threaded to receive the threaded rear end of the rifle barrel, which threaded rear end is cut away to provide a relief extending over an arc of 120° of the barrel face. Part of this relief is aligned with that one of the ribs carried on the bolt which terminates flush with the forward face of the bolt. The forward receiver ring is tapered or inclined at the lower rear side thereof adjacent the cartridge or shell magazine of the rifle to provide a steep ramp for guiding the cartridge into the chamber when the cartridge is rammed home by the bolt. The spaced or opposed receiver rails are relieved or cut away at the lower side to provide improved feeding of the cartridges from the cartridge magazine into the chamber.

In a preferred embodiment of the invention, the rear receiver ring is slotted or apertured at one side thereof to accommodate a bolt stop lug which is pivotally mounted in the receiver to project through the slot or aperture, and to interlock with a cooperating bolt stop slot provided in the side of the bolt in the space between two of the elongated axially extending ribs provided on the bolt.

The described construction of the bolt action of the present invention enables a number of advantages to be realized or achieved with respect to other widely used actions. The long, relatively thick and transversely broad ribs or rails evenly spaced in a circumferential fashion around the bolt over a major portion of its length afford a balanced distribution of forces acting on the bolt during its reciprocating movement in the receiver, so that the bolt does not become canted or cocked in the receiver at any time during operation of the action, and continues to work smoothly after hundreds of firings of the rifle. Further, this construction of the ribs on the bolt, in cooperation with the thick relatively large locking lugs provided in the rear receiver ring afford a large expanse of metal, evenly distributed around the bolt, to accept and dissipate recoil forces during firing.

Another advantage of the bolt action of the present invention is that the manner in which the rear face of the barrel screwed into the forward receiver ring is cut away, in combination or cooperation with the provision of that one of the ribs on the receiver which terminates flush with the forward face of the bolt, provides a gas port for venting gas (developed upon firing of the cartridge) downwardly through the cartridge magazine and away from the face of the shooter.

Another important advantage of the invention is the construction of the receiver rails in conjunction with the cartridge feeding ramp at the rear side of the forward receiver ring, in further combination with the location of the full length flush-terminating rib on the bolt, in such way that the cartridges are fed smoothly and evenly without binding from the magazine into the chamber, and the brass cartridge cases are not grooved or scored due to cutting action thereon by the receiver rails.

Yet another advantage of the present invention is the ease with which the bolt release stop can be operated, and the positive interlock which it affords with the cooperating locking groove or cavity formed in the bolt at the time when the bolt is retracted to its position of maximum retraction.

A further advantage of the present invention is the provision of a cocking indicator stud which cooperates with a cocking piece forming an element of the bolt action, which cocking indicator stud is positively and automatically activated, and provides a reliable indication to the shooter of the attainment of a cocked status of the rifle.

Additional objects and advantages of the invention will become apparent as the following detailed description of the invention is read in conjunction with the accompanying drawings which illustrate the invention.

DETAILED DESCRIPTION OF PREFERRED EMBODIMENTS OF THE INVENTION

Figure 1:
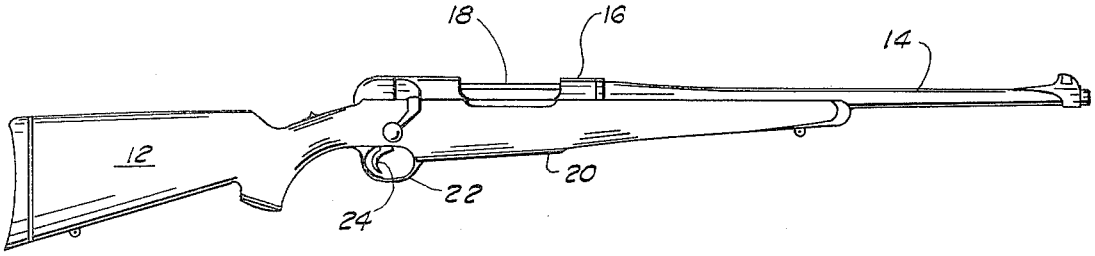
FIG. 1 is a side elevation view of a bolt action rifle which includes the improved bolt action of the present invention.
Figure 2:
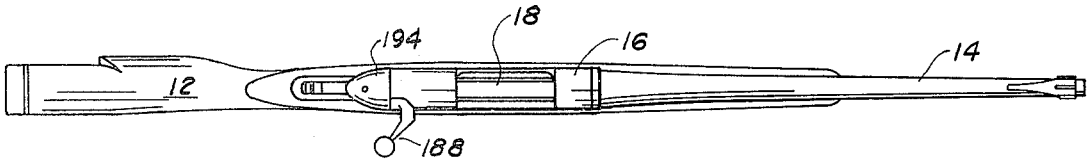
FIG. 2 is a plan view of the rifle depicted in FIG. 1.

Referring initially to FIG. 1 of the drawings, shown therein is a bolt action rifle constructed in accordance with the present invention and including the improved bolt action of the invention. The rifle includes a stock 12, a barrel 14 and a receiver 16 which is secured on the stock and threadedly receives the barrel. The rifle also includes a bolt assembly 18, a portion of which can be seen in FIG. 1, a magazine box 20, a trigger guard 22 and a trigger 24.

Figure 3:
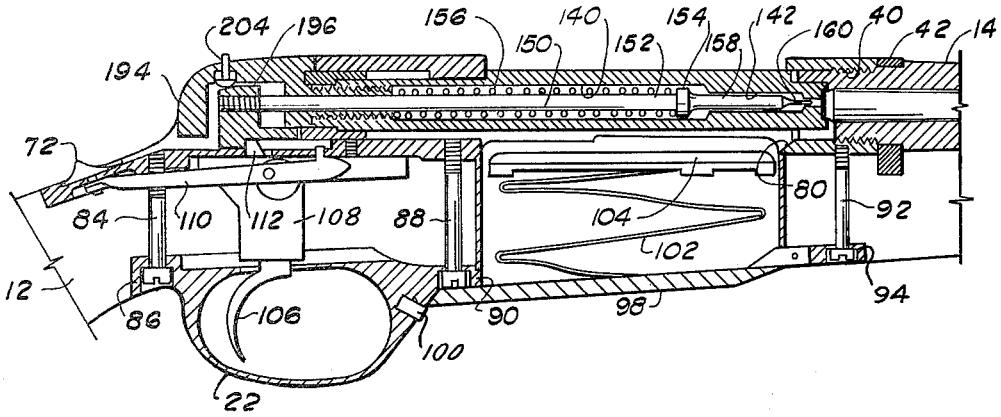
FIG. 3 is a side view, partly in section and partly in elevation, of the central portion of the rifle, showing the receiver, bolt, cartridge magazine, trigger mechanism and trigger guard, along with a rear portion of the rifle barrel.
Figure 4:
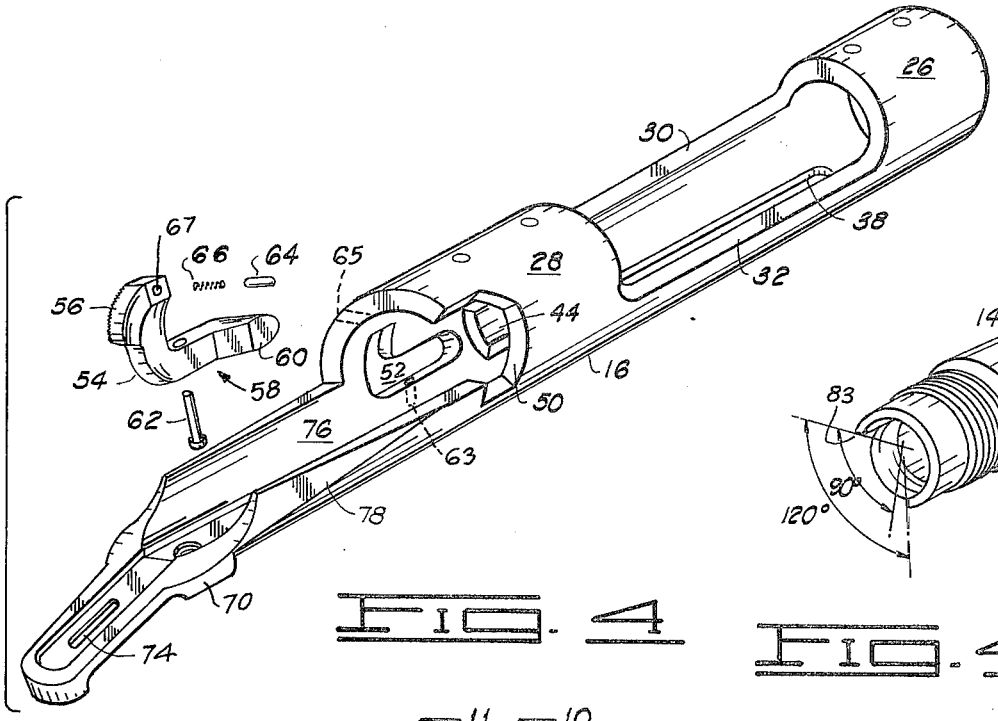
FIG. 4 is an exploded perspective view of a receiver forming a portion of the bolt action of the invention, and showing alongside the receiver, in exploded fashion, a bolt stop lug (and associated pins and springs) which is mounted in the registering aperture or opening formed in one side of the receiver.
Figure 5:
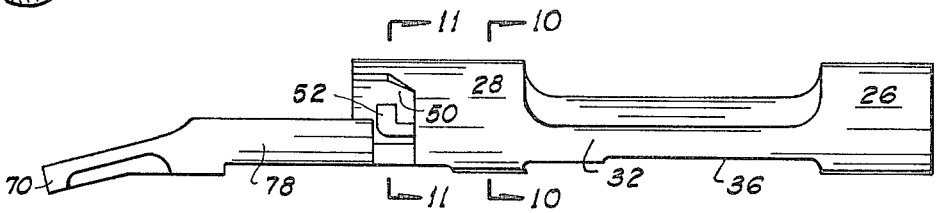
FIG. 5 is a side elevation view of the receiver depicted in FIG. 4.
Figure 6:
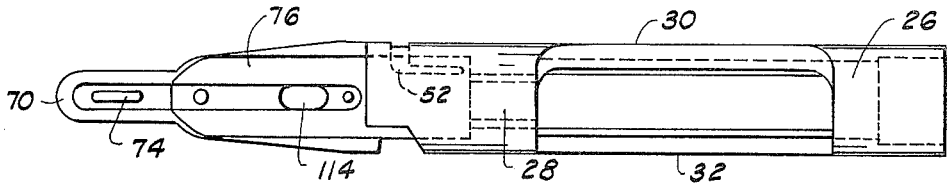
FIG. 6 is a top plan view of the receiver depicted in FIG. 4.
Figure 7:
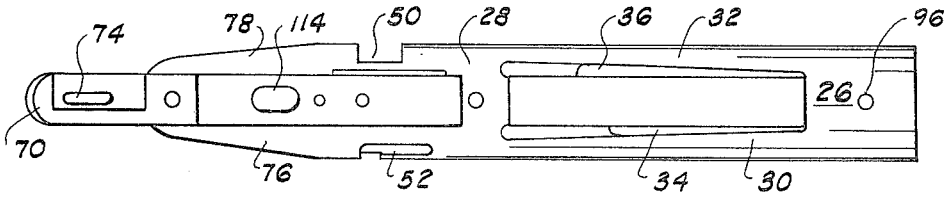
FIG. 7 is a bottom view of the receiver depicted in FIG. 4.
Figure 8:
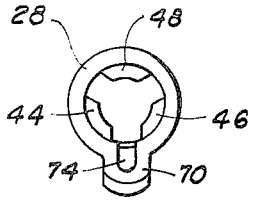
FIG. 8 is an end elevation view of the receiver as it appears when viewed from the rear (the shooter's) end thereof.
Figure 9:
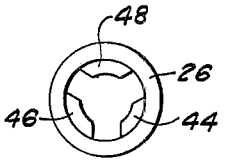
FIG. 9 is an end elevation view of the receiver as it appears when viewed from the forward end thereof.

Referring to FIGS. 3, 4, and 5 of the drawings, the receiver 16 will be perceived to include a forward receiver ring 26, a rear receiver ring 28 and a pair of transversely spaced receiver rails 30 and 32 which interconnect the forward and rear receiver rings. It will be noted in referring to FIG. 7, that the rails 30 and 32 are undercut or relieved as shown at 34 and 36, respectively, with the undercut or relief on the right rail 32 commencing a slight distance (usually about one-quarter inch) more rearwardly on the receiver than the relief 34 on the left rail 30. An opening 38 exists between the rails 30 and 32 to facilitate the feeding of cartridges from a magazine box located below the receiver in a manner hereinafter described. The forward receiver ring 26 has internal threads 40 formed thereon for threadedly receiving the rear end of the barrel 14 in the maner depicted in FIG. 3, and a shoulder is provided on the exterior of the barrel 14 at the end of the threaded portion to permit a recoil lug 42 to be secured between the forward end of the receiver and the shoulder on the barrel 14.

Figure 10:
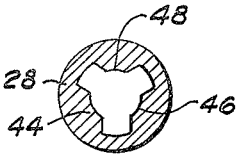
FIG. 10 is a section taken along line 10—10 of FIG. 5.
Figure 11:
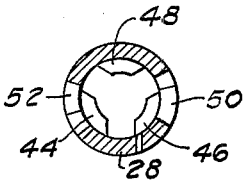
FIG. 11 is a section taken along line 11—11 of FIG. 5.
Figure 15:
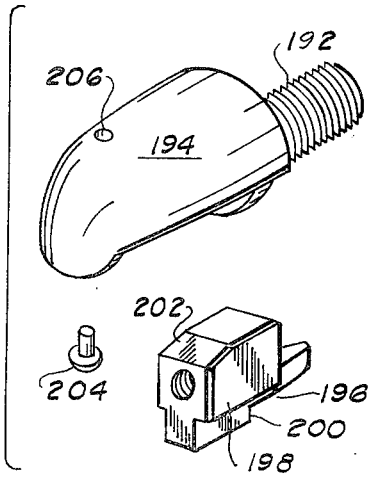
FIG. 15 is an exploded perspective view showing, in disassembled form, the bolt sleeve, cocking piece and cocking indicator stud utilized in the bolt action of the present invention.

The rear ring 28 of the receiver 16 is generally annular in configuration and has built up on the inner side thereof and projecting radially inwardly within this ring of the receiver, three locking lugs 44, 46 and 48 (see FIG. 10). Each of the locking lugs 44, 46 and 48 projects radially inwardly from the rear receiver ring and is arcuate in configuration so as to cover about 60° of arc within the bore through the receiver ring. Each of the locking lugs 44, 46 and 48 also projects a substantial axial distance along the receiver within the rear receiver ring 28. The manner in which the locking lugs cooperate with rails carried on the bolt employed in the bolt assembly will be hereinafter described.

At one of its sides, the rear receiver ring 28 is cut away or relieved to provide a bolt relief 50. It will be noted that this bolt relief 50 projects forwardly and downwardly in the rear receiver ring so that the bolt can be pushed into the bolt relief and then pivoted downwardly for locking the action prior to firing the rifle in a manner hereinafter described. In the opposite side of the rear receiver ring 28 from the bolt relief 50, an L-shaped opening or aperture 52 is provided to accommodate a bolt stop lug designated generally by reference numeral 54. The bolt stop lug 54 includes a finger plate 56 and a generally L-shaped lug body 58 which terminates at one end in an engagement toe 60. It will be perceived that the general configuration of the bolt stop lug 54 is complementary to the configuration of the L-shaped aperture 52 so that the bolt stop lug can be mounted in this aperture and retained in this position in the receiver 16 by means of a pin 62 extended through a hole 63 in the metal in the lower portion of the rear receiver ring. In order to resiliently bias the toe 60 of the lug body 58 inwardly so as to engage the bolt stop slot formed in the body of the bolt as hereinafter described, a small hole 65 is drilled in the upper side of the rear receiver ring 28 to accommodate a small pin or plunger 64 and a spring 66, with the plunger extending into the hole in the receiver and the spring extending into an aligned hole 67 in the upper end of the bolt stop lug opposite the finger plate 56. The bias of the spring 66 causes the bolt stop lug to normally be pivoted about the pin 62 so that the toe 60 bears against the side of the bolt and will snap into the bolt stop slot or opening, all as hereinafter described.

At the extreme rear end of the receiver 16, a back strap 70 is provided for purposes of securement of one end of the receiver to the stock 12 of the rifle, and receives a safety latch protuberance 72 which projects through a slot 74 formed in the back strap. It may be further pointed out that the receiver 16 further includes back rails 76 and 78 which act as guides for the bolt assembly when the same is inserted in, or removed from, the receiver 16 in a manner hereinafter described.

Figure 4A:
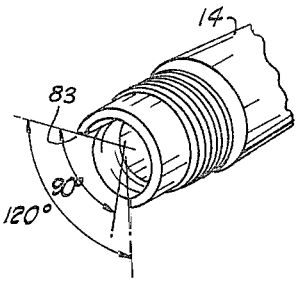
FIG. 4a is a perspective view of the rear end of the rifle barrel showing the location of a 120° relief therein.

Before departing from the description of the receiver 16, it should be further pointed out that the forward ring 26 of the receiver 16 is radially beveled or inclined at a steep angle as shown in FIG. 3, so as to provide a cartridge seating ramp 80. The cartridge seating ramp 80 is provided at the lower side of the forward receiver ring 26 in alignment with the slot 38 between the rails 30 and 32, and immediately adjacent the rear face of the barrel 14. It will be noted that the rear face of the barrel 14 is relieved or cut away over about 120° of its total annular extent as indicated by reference numeral 83 in FIG. 4*a*. The relief thus provided extends counterclockwise from a location which is about 30° to the right of a vertical plane extended through the barrel, to a horizontal plane extended through the barrel axis. The threads on the rear end portion of the barrel cooperate with the threads 40 in the forward ring 26 of the receiver so that when the barrel is screwed into the receiver, the rear face of the barrel has the attitude depicted in FIG. 4*a* — that is, the lower left quadrant of the rear face of the barrel is relieved or cut away, in addition to about 30° of the lower right quadrant of the rear face, making a total relief of 120° at this location.

The receiver 16 is secured to the stock 12 by means of a bolt 84 which is extended through the escutcheon of a trigger plate 86 forming a portion of the trigger guard 22, and also by means of a bolt 88 passed through the escutcheon of a forward trigger plate 90. A third bolt or bedding screw 92 is extended through the escutcheon of a plate 94 into a threaded hole 96 in the lower side of the forward receiver ring (see FIGS. 3 and 7).

A floor plate 98 is pivotally connected at one of its ends of the plate 94, and is retained in its closed position at the bottom of the magazine box by means of a floor plate latch 100 set into the forward side of the trigger guard 22. A follower spring 102 has its lower end secured to the upper side of the floor plate 98 and its upper end portion engaged in suitable slots formed on the under side of a cartridge follower plate 104. The cartridge follower plate 104 is positioned immediately beneath the slot 38 formed in the lower side of the receiver 16 so that cartridges are forced through this slot by the follower plate 104 as it is urged upwardly by the follower spring 102.

A trigger 106 is connected by a conventional linkage 108 to a safety lever 110 and a sear 112. The sear 112 projects through a slot 114 provided in the lower side of the rear portion of the receiver 16 and engages a shoulder formed on a cocking piece constituting the portion of the bolt assembly hereinafter described.

The bolt assembly of the invention is best illustrated in FIGS. 12 – 15. The bolt assembly 18 includes an elongated, hollow, generally cylindrical bolt body 120. The bolt body 120 has a forward end face 122 and a rear end face 124. On its outer periphery, the bolt body carries three axially extending, elongated parallel bolt rails 126, 128 and 130. Each of the bolt rails 126, 128 and 130 is arcuate in transverse configuration and extends over about 60° of the arcuate outer periphery of the cylindrical bolt body. The lengths of the bolt rails 126, 128 and 130 vary, with the rails 126 and 128 being substantially equal in length and extending from a forward end (which is spaced rearwardly from the front face 122 of the bolt body 120) to a location spaced well forward of the rear face 124 of the bolt body. The rail 130, while terminating at its rear end at a location aligned with the rails 126 and 128, differs from the latter rails by extending all the way to the forward face 122 of the bolt body 120.

It will be perceived that the described configuration and location of the rails 126, 128 and 130 requires the separation of the rails by spaces existing therebetween and exposing in such space, the outer peripheral surface of the bolt body 120. Positioned in one of these spaces disposed between the bolt rail 126 and the bolt rail 130 about ¾ of the way toward the forward end of the bolt rail 126 is a bolt stop slot 134. It will be perceived that the bolt stop slot 134 has a well defined abrupt or perpendicular forward end wall 134*a* and has an inclined or tapered rear end wall 134*b*. The purpose of this geometry will be hereinafter explained.

It will be noted in referring to FIG. 13 that a corner at the rear end of each of the rails 126, 128 and 130 is cut away to provide a beveled camming surface (as typified by the beveled camming surface 126*a*) so that the bolt body can be cammed into its locked or seated position, immediately prior to firing, by cooperation between the locking lugs 44, 46 and 48 in the rear receiver ring 28 with the bolt rails 126, 128 and 130 in a manner hereinafter described.

Figure 16:
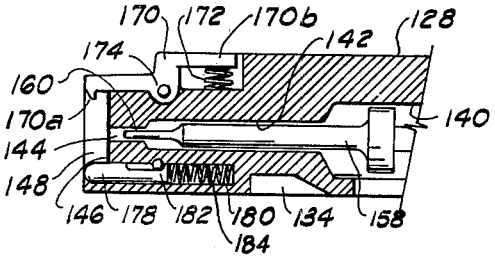
FIG. 16 is a longitudinal sectional view taken in a vertical plane passed through the center of the forward end of the bolt, and illustrating parts of the firing pin mechanism, the extractor mechanism and the ejector mechanism utilized in the bolt action of the invention.
Figure 12:
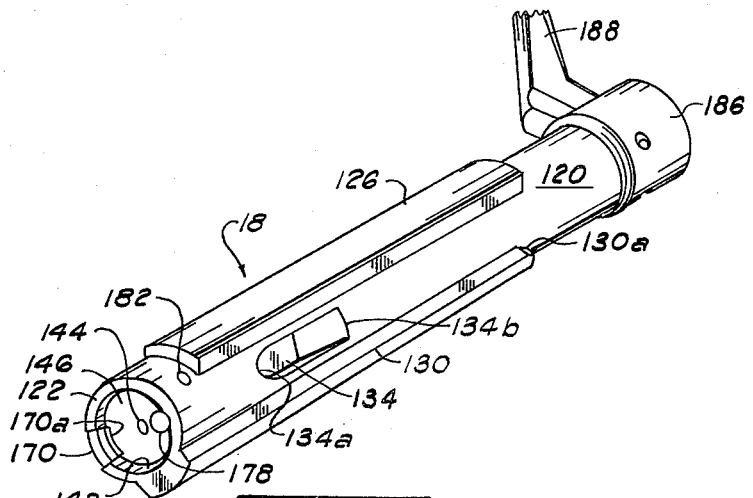
FIG. 12 is a perspective view of the bolt used in the bolt action of the present invention as the bolt appears when viewed from the forward end thereof.
Figure 13:
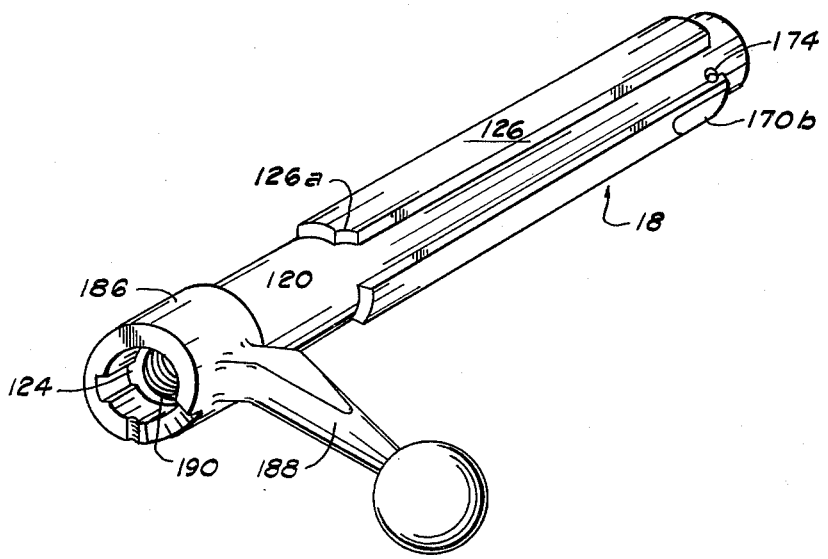
FIG. 13 is a perspective view of the bolt as it appears when viewed from the rear end thereof.

The internal configuration of the hollow cylindrical bolt body 120 is best illustrated in FIGS. 13 and 16. Here it will be perceived that the bolt body is provided with an elongated, axially extending bore 140 which projects inwardly into the bolt body from the rear end thereof to a point about ¾ of the way from the rear end toward the forward end of the bolt body. The bore 140 there intersects a relatively small counterbore 142 which communicates with a relatively small orifice 144 opening in a recessed face 146 disposed adjacent the forward face 122 of the bolt body 120. It will be noted in referring to FIGS. 12 and 16 that the recessed face 146 is a surface disposed rearwardly from the foremost or leading end of the bolt body 120, and is surrounded by an annular cartridge seating flange 148 which terminates in the forward face 122 of the bolt body.

Slidably positioned within the hollow interior of the cylindrical bolt body 120 is an elongated firing pin mechanism designated generally by reference numeral 150. The firing pin mechanism 150 includes a main firing pin shaft 152 which carries a spring stop shoulder 154 at the forward end thereof and which projects from the rear end of the bolt body 120 for connection to a cocking piece in the manner hereinafter described. A helical spring 156 is positioned around the main firing pin shaft 152 and bears at its forward end against the spring stop shoulder 154. Forward of the main firing pin shaft 152 is a firing pin 158 which is slidably mounted in the counterbore 142 and has a firing pin tip 160 aligned with the orifice 144 and dimensioned to reciprocate through this orifice for the purpose of firing a cartridge seated in the chamber of the rifle.

Figure 14:
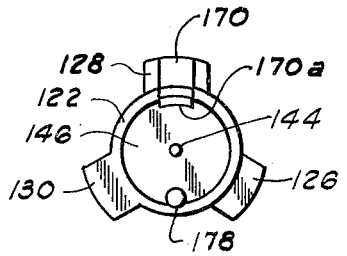
FIG. 14 is a view in elevation of the forward end of the bolt showing the ribs or rails carried thereon and the extractor and ejector mechanisms carried on the bolt.

Extractor and ejector mechanisms are provided at the forward end of the bolt body 120 and are best illustrated in FIGS. 14 and 16 of the drawings. The extractor mechanism includes an extractor latch 170 having a forward portion which carries an extractor toe 170*a*, and an offset rear portion 170*b* which is seated in a mating slot formed in the bolt rail 128, and is biased radially outwardly with respect to the axis of the bolt body by means of a spring 172. The extractor lever is pivotally mounted on the bolt body by means of a pivot pin which is passed through portions of the bolt rail 128, and through an aperture formed in a lug carried on the extractor lever 170 adjacent the angulation which joins the rear portion of 170*b* of the extractor lever to the forward portion thereof.

The ejector mechanism which is mounted in the bolt body 120 adjacent the forward face 122 thereof includes an ejector pin 178 having a portion seated in a recess 180 bored in the bolt body 120 at the end portion thereof just inside and adjacent the annular flange 148 and on the opposite side of the bolt body from the extractor latch 170. The ejector pin is relieved adjacent its rear end to accommodate a stop pin 182 which is extended transversely through the bolt body 120. A compression spring 184 is located in the recess 180 and biases the ejector pin 178 to the position depicted in FIG. 16.

The rear end portion of the bolt body 120 which is externally threaded in the manner previously described is threaded into an annular bolt handle shroud 186. The rear end face 124 of the bolt body 120 bears against a radial shoulder formed internally in the bolt handle shroud 186. Formed integrally with the bolt handle shroud 186 is a bolt handle 188. The rear end portion of the bolt body 120 also carries an internal thread 190 which extends axially in the hollow interior of the bolt body 120 for a short distance from the end face 124. Threadedly engaging the threads 190 is an externally threaded hollow tubular protuberance 192 which projects from a bolt sleeve 194.

The bolt sleeve 194 has a cavity toward the rear side thereof for receiving a cocking piece designated generally by reference numeral 196. The cocking piece 196 includes a head portion 198 which has a threaded bore therein to receive a threaded portion of the main firing pin 152. At its lower side, the cocking piece has a forwardly facing shoulder 200 which abuts the sear 112 when the rifle is cocked. The cocking piece head has a downwardly and rearwardly beveled cam surface 202 formed at the rear upper side thereof, and this cam surface cooperates with a cocking indicator stud 204 to provide an indication of the cocked status of the rifle. The cocking indicator stud 204 projects upwardly through an opening or aperture 206 formed at the rear side of the bolt sleeve 194, and is in its elevated position when the cocking indicator stud rides on the flat top surface of the cocking piece 196, and is dropped from sight within the bolt sleeve when the cocking indicator stud rides downwardly on the beveled surface 202 after the rifle has been fired.

Operation

The bolt action of the present invention is assembled by mounting the receiver 16 on the stock 12 of the rifle, then screwing the barrel into the receiver so that the rear end of the barrel is positioned in the forward receiver ring 26 with the relief or 120° cutaway in the rear end face of the barrel oriented in the manner hereinbefore described - that is, so that the lower left quadrant, and 30° of the lower right quadrant, of the annular face at the rear end of the barrel constitutes the relieved portion thereof. With the barrel thus secured in the forward receiver ring 26 in the position described, the bolt assembly 18 is then placed in the receiver by commencing to slide the forward end of the bolt body 120 between the back rails 76 and 78 of the receiver 16. The bolt is moved into the receiver by aligning the longitudinal axis of the bolt body 120 with the longitudinal axis of the receiver.

As the forward end face 122 of the bolt body 120 strikes the engagement toe 60 of the bolt stop lug 54, a beveled surface adjacent the engagement toe causes the bolt stop lug to be pivoted outwardly to allow the bolt body 120 to be passed thereby. The forward end of the bolt body next approaches the locking lugs 44, 46 and 48 carried inside the rear receiver ring 28. In order to permit the bolt body 120 to continue its sliding movement in the receiver 16, it is necessary that the spaces or grooves between the bolt rails 126, 128 and 130 be aligned with these locking lugs to permit the locking lugs to pass between the bolt rails. With the bolt body 120 so aligned, sliding movement of the bolt body forward in the receiver 16 is continued until the bolt handle 188 carried on the bolt handle shroud 186 is positioned in the bolt relief 50 formed in the rear receiver ring 28.

It should be noted that as the bolt assembly 18 undergoes sliding movement forward in the receiver 16, it is maintained in a precise position relative to the receiver and barrel by the interengagement between the locking lugs 44, 46 and 48 and the bolt rails 126, 128 and 130. In this position, the elongated rail 130 is disposed at the lowermost side of the bolt body 120 and in direct alignment with the 120° cutaway or relief formed in the rear face of the barrel 14. Thus, the forward end of the elongated rail 130 can pass into this relief 83 in the rear face of the barrel 14 and during the movement of the bolt assembly, passes directly over the steeply inclined ramp 80 formed at the rear entrance to the forward receiver ring 26. The importance of these relative positions of the elongated rail 130 carried on the bolt body 120 with respect to the relief or cutaway 83 in the barrel 14, and with respect to the seating ramp 80 will be hereinafter discussed.

After the bolt assembly has been moved all the way forward in the receiver 16 in the manner described, the bolt body 120 is rotated in the receiver by pulling down on the bolt handle 188 to move it down into the lower portion of the bolt relief 50 formed in the rear receiver ring 28. This rotative movement of the bolt body 120 within the receiver 16 causes the bolt rails 126, 128 and 130, which in this position have moved forward of and cleared the locking lugs 44, 46 and 48, to rotate into axial alignment with these locking lugs so that the bolt rails 126, 128 and 130 are backed up by, and are in abutting contact with, the locking lugs 44, 46 and 48. It should further be noted that firm seating of the bolt body 120 in its forwardmost (action closing) position in the receiver 16 and immediately adjacent the bore through the barrel 14 is furthered by the camming action afforded by the beveled camming surfaces 126*a*, 128*a* and 130*a* formed at the rear ends of the bolt rails.

Rotation of the bolt body 120 within the receiver 16 in the manner described also functions to move the forward end of the elongated rail 130 in rotation about the axis of the bolt body 120 so that this bolt rail is moved from a position in which it lies close to the lower right extremity of the 120° cutaway or relief 83 in the rear face of the barrel, to a position removed 60° in a counterclockwise direction from this position. In other words, after the bolt handle 188 has been pulled down to the action closing position, the elongated bolt rail 130, which is 60° in its transverse arcuate dimension around the periphery of the cylindrical bolt body 120, has been moved through 60° to a position where it closes or blocks the 60° increment of the relief 83 which is located at the most counterclockwise extreme of the relief. This then leaves a 60° incement of the relief open in the sense of not being obstructed by any of the bolt rails. Viewed in another way, the described arrangement permits a passageway to exist from the bore of the barrel 14 through the open portion of the relief 83 to the top of the magazine box 20. The purpose of this passageway is to allow gases developed upon firing of the cartridge and escaping around the cartridge in the direction of the bolt body 120 to be vented downwardly through the magazine box so that the forces of the expanding gases thus produced are dissipated, rather than being fully exerted in a direction tending to drive the bolt assembly rearwardly, and the venting of the gases which thus occurs is in a direction away from the shooter's face.

With the bolt assembly 18 seated in the receiver 16 in the manner described, the magazine box 20 may be loaded with a plurality of cartridges in a conventional fashion, with loading being achieved through the opening provided when the floor plate 98 is pivoted downwardly. The cartridges are fed upwardly toward the opening 38 in the lower side of the receiver 16 by the cartridge follower plate 104 under the influence of the follower spring 102. In the improved bolt action of the present invention, the cartridges enter the receiver 16 through the opening 38 in such a way that they do not bind up, nor are they cut by the opposed edges of the right and left receiver rails which define the boundaries of the opening 38. The free movement of cartridges into the path of the reciprocating bolt body 120 is facilitated by the reliefs 34 and 36 cut in the lower edges of the left and right receiver rails 30 and 32, respectively. These reliefs afford clearance for the cartridge cases. The right receiver rail 32 has its relief 36 originated at a point rearward of the relief in the right receiver rail 30 for the reason that generally, the cartridges feeding up from the left side of the magazine box 20 have been found to feed more freely if the reliefs in the two rails are staggered or offset in this fashion.

As the cartridge is fed upwardly through the opening 38 between the receiver rails 30 and 32, the cartridge is initially engaged by the leading end of the elongated bolt rail 130. As the bolt assembly 18 is moved forwardly in the receiver 16, the cartridge is pushed in the direction of the chamber in the rear end of the barrel. The leading end of the cartridge first encounters the steeply inclined seating ramp 80 formed in the rear lower side of the forward receiver ring 26, and is guided upwardly by a camming action offered by this ramp. In many rifles as heretofore constructed, this pivoting action on the cartridge as the forward end thereof moves across the ramp provided in the forward receiver ring is such that scoring or cutting of the cases of the cartridge has been experienced by reason of the binding of the cases against the lower edges of the spaced receiver rails. Here, however, the steep inclination of the seating ramp 80, in conjunction with the reliefs 34 and 36 provided in the left and right receiver rails 30 and 32, respectively, avoids scoring or grooving of the case, and thus leaves the case unmarred after firing and well suited for reloading if desired.

After the cartridge has been shoved home by the bolt body 120, the head space then existing between the cartridge seated in the chamber and the forward end face 122 of the bolt body 120 is in communication with the gas vent passageway through the relief 83 to the magazine box as hereinbefore described. When the bolt assembly has been pushed all the way forward to seat the round to be fired in the chamber, and the bolt handle 188 is pulled down to the action closing position, the rifle is cocked by engagement between the cocking piece 196 and the sear 112 in a manner well understood in the art. At this time, the cocking piece 196 occupies a position which is relatively rearwardly located in the bolt sleeve 194, and in this position the cocking indicator stud 204 rides on the top side of the cocking piece. In this position, it is biased upwardly so that the upper end of the cocking indicator stud projects above the top surface of the bolt sleeve 194 and is clearly visible to the shooter. He is thus visually apprised of the cocked status of the rifle.

When the rifle is fired, pulling of the trigger 106 releases the sear 112 from engagement with the cocking piece 196, allowing the helical spring 156 to drive the firing pin shaft 152 forwardly in the bore 140 in the bolt body 120. This forward movement of the firing pin shaft 152 carries with it the cocking piece 196, and also drives forwardly within the counterbore 142, the firing pin 158 and the firing pin tip 160. The firing pin tip is thus projected through the orifice 144 formed in the recessed face 146 at the forward end of the bolt body 120 and fires the cartridge seated in the chamber.

After firing of the cartridge is completed and any gas escaping around the cartridge has been vented through the gas passageway via the relief 83, the cartridge may be extracted by moving the bolt handle 188 upwardly and then reciprocating the bolt handle rearwardly within the receiver 16. At this time, the extractor latch 170 has become engaged with the rim of the cartridge and holds the base of the cartridge in flatly abutting contact with the recessed face 146 at the forward end of the bolt body 120. Moreover, the ejector pin 178 has been forced back into the recess 180 to load the compression spring 184 preparatory to ejecting the cartridge case when the forward end of the bolt clears the forward receiver ring 26. Once the forward face 122 of the bolt body 120 has cleared the forward receiver ring 26, the cartridge case can then be ejected as the ejector pin 178 snaps forward to relieve the compression spring 184.

When it is desired to remove the bolt assembly from the receiver 16, the motions used to seat the bolt assembly in the receiver which have been previously described are reversed. Thus, the bolt is pulled rearwardly in the receiver 16 after the handle 188 has been pivoted upwardly to align the spaces between the bolt rails 126, 128 and 130 with the locking lugs 44, 46 and 48 carried in the rear receiver ring 28. The bolt can then continue to slide rearwardly in the receiver 16 until a point is reached where the engagement toe 60 of the bolt stop lug 54 snaps into the bolt stop slot 134. At this time, the leading side of the engagement toe 60 will engage the leading side of the bolt stop slot 134 and positively interlock with the bolt stop slot to prevent further rearward reciprocating or sliding movement of the bolt body 120 within the receiver 16. Thus, it is not possible to completely withdraw the bolt assembly without releasing the engagement of the bolt stop lug 54 with the bolt stop slot 134 formed in the bolt body 120. Such disengagement can be easily effected, however, by simply pressing upon the finger plate 56 of the bolt stop lug 54 so that the lug is pivoted about the pivot pin 62 to move the engagement toe 60 radially outwardly with respect to the bolt body 120. This movement disengages the bolt stop lug 54 from the bolt stop slot 134 and allows the bolt assembly to be completely removed from the receiver.

From the foregoing description of the invention, it will be perceived that the bolt action of this invention provides several improved and highly useful features, including the safe venting of any gas escaping around the cartridge from the chamber and passing rearwardly in the general direction of the shooter, the provision of an accessible and easily utilized bolt stop lug for permitting the entire bolt assembly to be slid quickly and freely from the receiver, the positive guidance of the bolt body in the receiver by engagement of the triple, equally spaced bolt rails with three cooperating locking lugs, and the inclusion of relieved receiver rails along with a steeply inclined seating ramp at the rear lower side of the forward receiver ring to facilitate the smooth and trouble free seating of cartridges in the chamber as they are fed from the magazine box. Other important features render the bolt action of the invention highly reliable, mechanically strong and trouble free in action over long periods of operation.

Although a preferred embodiment of the invention has been herein described, it will be understood that various changes and alterations in the details of the structure can be effected without departure from the basic principles of the invention. Changes and innovations of this type are therefore deemed to be circumscribed by the spirit and scope of the invention except as the same may be necessarily limited by the appended claims or reasonable equivalents thereof.

What is claimed is:

1. A bolt action for a rifle of the type which includes a barrel, a stock and a sear comprising:

an elongated receiver adapted for securement to the rifle stock and having:

an internally threaded forward receiver ring adapted for threadedly engaging one end of the rifle barrel, and having an inclined ramp at one side thereof offset from the central longitudinal axis of the receiver;

a rear receiver ring spaced axially along the receiver from the forward receiver ring;

a plurality of circumferentially spaced, radially inwardly extending arcuate locking lugs secured inside said rear receiver ring and separated from each other by axially extending spaces;

a pair of spaced, elongated receiver rails extending between, and interconnecting, said forward and rear receiver rings, the space between said rails being aligned with said inclined ramp, and each of said rails having being relieved over a portion of the length thereof and adjacent the space therebetween;

an elongated hollow cylindrical bolt body slidably mounted in said receiver and rotatable about the longitudinal axis thereof and within the forward and rear rings of the receiver, and having a forward end and a rear end; and at least three spaced, elongated, substantially parallel bolt rails secured to said bolt body and extending axially therealong, two of said bolt rails being of substantially equal length and terminating at points spaced from the forward and rear ends of the bolt body, and a third body rail extending to, and terminating flush with, the forward end of the bolt body, said bolt rails being dimensioned and positioned so that, in one status of the bolt body, said bolt rails are aligned to slide between said locking lugs in said axially extending spaces, and in a second status of the bolt body, to be aligned with and bear against, at one of their ends, said locking lugs.

2. A bolt action for a rifle as defined in claim 1 wherein said bolt body is further characterized in having a bolt stop slot disposed between said bolt rails; and said bolt action is further characterized in including a bolt stop lug pivotally mounted in said rear receiver ring and including a finger plate exposed on the outer side of said rear receiver ring, and an engagement toe projecting into said rear receiver ring and bearing against said bolt body in a position to engage said bolt stop slot as said bolt is reciprocated in the receiver.

3. A bolt action as defined in claim 1 and further characterized as including:

a bolt handle stroud threaded on the rear end of said bolt body and detachably pinned thereto; and a bolt handle secured to, and projecting from, said bolt handle stroud.

4. A bolt action as defined in claim 1 and further characterized as including:

an apertured bolt sleeve threadedly connected to the rear end of said bolt body and reciprocably supported on said receiver;

a cocking piece movably housed in said bolt sleeve and adapted for intermittent cocking engagement with the sear of the rifle;

a firing pin assembly slidably mounted in the hollow bolt body and having an end connected to said cocking piece; and a cocking indicator stud movably mounted in the aperture in said bolt sleeve and contacting surfaces of said cocking piece to be cammed thereby to movement in said aperture between a position of visible exposure to the shooter of the rifle, and a retracted position of obscurity within the aperture.

5. A bolt action as defined in claim 1 wherein said bolt body is further characterized in having:

an annular flange at the forward end thereof terminating in a forward end face;

a recessed face at the forward end of said bolt body surrounded by said annular flange; and wherein said bolt action is further characterized in including:

an extractor latch pivotally mounted on said bolt body at the forward end thereof in alignment with one of said two bolt rails and including:

a forward portion carrying a toe projecting radially inwardly from said annular flange for engaging a cartridge case seated against said recessed face; and a rear portion offset from said forward portion and disposed on the opposite side of the pivotal axis of the extractor latch from said forward portion, said rear portion being positioned in a registering slot in said one of said two bolt rails; and a spring in said registering slot bearing against said rear portion of the extractor latch for resiliently biasing the latch to its latching position.

6. A bolt action as defined in claim 1 wherein there are three of said bolt rails, with each of said bolt rails having an arcuate, transverse cross section covering about 60° of the outer circumference of the bolt body with equal spaces between adjacent bolt rails; and wherein there are three of said locking lugs with each of said locking lugs being of arcuate, transverse cross section and covering about 60° of the inner circumference of the rear receiver ring with equal spaces between adjacent locking lugs.

7. A bolt action as defined in claim 1 wherein the receiver rail on the left side of said receiver as related to a shooter pointing the rifle is relieved over a lesser portion of its total length and the receiver rail on the right side of said receiver, and the relief in the left receiver rail originates at a point forward of the point of origination of the relief in the right receiver rail.

8. A bolt action as defined in claim 2 wherein said hollow bolt body has a bore extending from the rear end forwardly in said bolt body, and a counterbore intersecting the forward end of said bore and extending forwardly therefrom, and wherein said bolt stop slot is formed in the outer surface of said bolt body at a location radially aligned with said counterbore.

9. A bolt action as defined in claim 2 and further characterized as including:

a bolt handle shroud detachable secured to the rear end of said bolt body; and a bolt handle secured to, and projecting from, said bolt handle shroud.

10. A bolt action as defined in claim 3 and further characterized as including:

an apertured bolt sleeve having a portion extending through said bolt handle shroud and connected to the rear end of said bolt body;

a cocking piece movably mounted in said bolt sleeve and adapted for intermittent engagement with the sear of the rifle;

a firing pin assembly slidably mounted in the hollow bolt body and having an end connected to said cocking piece; and means projecting from the bolt sleeve and cooperating with the cocking piece for indicating the cocked and uncocked status of the rifle in response to movements of the cocking piece.

11. A repeating bolt action rifle comprising:

a rifle stock;

an elongated receiver secured to the rifle stock;

a cartridge magazine box mounted in the stock below the receiver;

a barrel connected to one end of the receiver and having an end face positioned in the forward end of the receiver, said barrel end face being relieved over an angular extent of about 120° around the bore of the barrel at the lower side thereof;

an elongated cylindrical bolt body having a forward end and a rear end slidably and rotatably mounted in the receiver in alignment with the barrel; and three elongated, spaced bolt rails carried on the outer periphery of the bolt body and each having an arcuate transverse configuration, one of said elongated bolt rails extending to, and terminating flush with, the forward end of said bolt body and aligned with the relief in the end face of said barrel in all positions of said bolt body whereby said one bolt rail will block a portion of said relief when said bolt body is in the action closing position.

12. A rifle as defined in claim 11 wherein said one elongated bolt rail has a transverse width covering about 60° of arc around the outer periphery of the bolt body, and blocks half of said 120° relief in the barrel end face when the rifle action is closed whereby a gas vent passageway is provided from the barrel to the magazine box.

* * * * *